US007963885B2

(12) United States Patent
Mazzanobile et al.

(10) Patent No.: US 7,963,885 B2
(45) Date of Patent: Jun. 21, 2011

(54) CHASING TRAINING DEVICE

(76) Inventors: Paul Mazzanobile, Surf City, NJ (US); Evan Baumgarten, Wyckoff, NJ (US)

( * ) Notice: Subject to any disclaimer, the term of this patent is extended or adjusted under 35 U.S.C. 154(b) by 0 days.

(21) Appl. No.: 12/646,899

(22) Filed: Dec. 23, 2009

(65) Prior Publication Data

US 2010/0167875 A1 Jul. 1, 2010

Related U.S. Application Data

(60) Provisional application No. 61/140,358, filed on Dec. 23, 2008.

(51) Int. Cl.
*A63B 24/00* (2006.01)

(52) U.S. Cl. ..... 482/4; 482/148

(58) Field of Classification Search ..... 482/1–9, 482/148; 446/431; 70/253
See application file for complete search history.

(56) References Cited

U.S. PATENT DOCUMENTS

| | | | | |
|---|---|---|---|---|
| 5,083,968 | A * | 1/1992 | Hart | 446/431 |
| 6,968,592 | B2 * | 11/2005 | Takeuchi et al. | 15/319 |
| 7,625,314 | B2 * | 12/2009 | Ungari et al. | 482/1 |
| 7,658,694 | B2 * | 2/2010 | Ungari | 482/1 |
| 2006/0106496 | A1 * | 5/2006 | Okamoto | 700/253 |
| 2008/0254945 | A1 * | 10/2008 | Beyzavi-Armani | 482/8 |

* cited by examiner

*Primary Examiner* — Fenn C Mathew
(74) *Attorney, Agent, or Firm* — West & Associates, A PC; Stuart J. West; Charlotte Rodeen-Dickert

(57) ABSTRACT

An athletic training device to develop speed and agility. A robot can be programmed or remote controlled to move in an erratic manner so that it can be chased by an athlete. An on-board shut-off unit stops the device when it is removed by the athlete chasing the device.

13 Claims, 7 Drawing Sheets

CHASING TRAINING DEVICE

CLAIM OF PRIORITY

The following application claims priority to U.S. Provisional Patent Application No. 61/140,358, filed Dec. 23, 2008, the complete contents of which is hereby incorporated herein by reference.

BACKGROUND

1. Field of the Invention

The invention relates generally to athletic training devices and more particularly to an erratically and rapidly moving device configured such that in order to be captured an athlete must exhibit a required level of speed and agility.

2. Background

Speed and agility are critical in numerous sports and other activities. However, motion in predictable patterns and/or on agility courses can be seen in advance and can be quickly learned by athletes. Existing training systems include stationary courses such as ladder drills, running through tires, or basketball "suicide" drills. Further systems exist, such as targeted chasing systems wherein an athlete moves as rapidly as possible towards a selected one of a set of illuminable lights. However, the selectively illuminable lights are stationary and thus the athlete can quickly adapt and/or anticipate the illumination sequence and/or memorize the locations of the fixed number of illuminable lights. In actual play, however, the motion may be unpredictable, and athletes must be able to still move quickly.

What is needed is a system that provides unpredictable speed and agility training for athletes.

DETAILED DESCRIPTION

Figure 1:
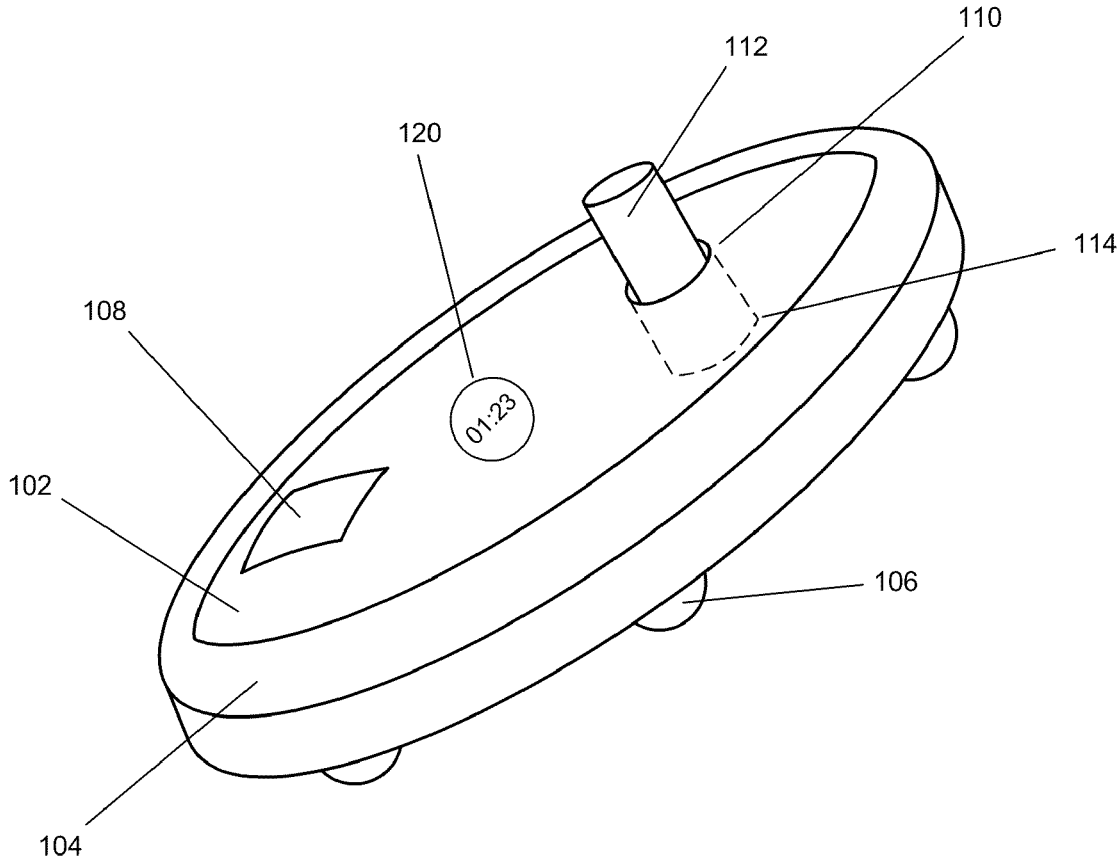
FIG. 1 depicts a perspective view of the exterior of an embodiment of the present device.
Figure 1A:
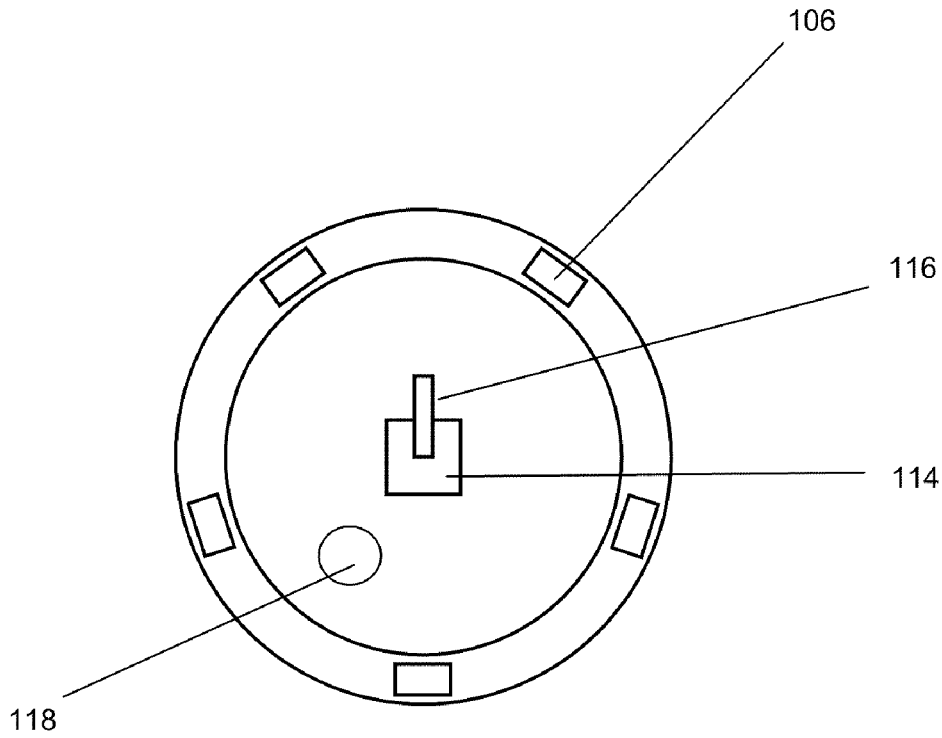
FIG. 1*a* depicts a bottom view of the exterior of an embodiment of the present device.
Figure 1B:
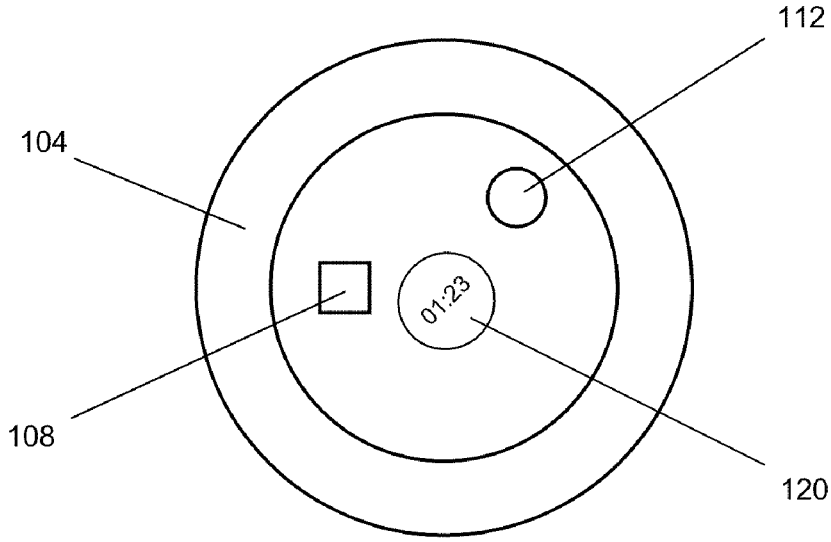
FIG. 1*b* depicts a top view of the interior of an embodiment of the present device.

FIGS. 1-1B depict various views of embodiments of the present device. FIG. 1 depicts a perspective exterior view of one embodiment of the present device. In some embodiments, a housing 102 can comprise a plurality of sections 104, which can be coupled together and substantially vertically arranged. In such embodiments, sections 104 can move independently of each other, or in coordinated movements with each other. However, in other embodiments, a housing 102 can comprise a single hollow member. As shown in FIG. 1, a housing 102 can be substantially circular in shape, but in other embodiments can have any other known and/or convenient geometry. In some embodiments, a housing 102 can be made of a resilient plastic, polymer, polycarbonate, metal, alloy, or any other known and/or convenient material. As shown in FIG. 1, a housing 102 can be coupled with a time mechanism 120, such as but not limited to, a timer, stopwatch, clock, and/or any other known and/or convenient mechanism for timing a user and/or displaying time.

As shown in FIG. 1*a*, a plurality of moving agencies 106 can be coupled with a housing 102. Moving agencies 106 can be wheels, casters, bearings, or any other known and/or convenient device. In some embodiments, moving agencies 106 can have a rotational range of motion of 360 degrees, or any other known and/or convenient range. As shown in FIG. 1*a*, moving agencies 106 can be coupled with a housing 102 at points on the underside of and, in some embodiments, substantially proximal to the periphery of a housing 102. However, in other embodiments, moving agencies 106 can be coupled with a housing 102 in any known and/or convenient locations.

In some embodiments, one of the moving agencies 106 can be configured to drive a housing 102 in any desired direction. In some embodiments, the moving agencies 106 can be configured to randomly drive a housing 102 in any direction. In alternate embodiments, more than one of the moving agencies 106 can be configured to drive the housing 102 either separately and/or simultaneously.

In some embodiments, a switch 108 can be located on the top surface of a housing 102, but in other embodiments can be located on a side or underside surface. An on-off switch 108 can be adapted to selectively control the operation of the moving agencies 106, drive system 114, and/or power the device on and off.

In the embodiment depicted in FIG. 1, a housing 102 can include an opening 110 adapted to receive a shut-off unit 112. In some embodiments, an opening 110 can be substantially circular, but in other embodiments can have any other known and/or convenient geometry. In the embodiment depicted in FIG. 1, a shut-off unit 112 can be selectively and operatively mated with an opening 110 such that a device will not be propelled when a shut-off unit 112 is not mated with an opening 110. A shut-off unit 112 can have a substantially cylindrical shape, as shown in FIG. 1, but in other embodiments can have any other known and/or convenient geometry. In some embodiments a shut-off unit 112 can be magnetized in a desired configuration and an opening 110 can include a magnetic reader such that the pattern and/or random sequence can be defined by the magnetic configuration of a shut-off unit 112 and/or the speed of insertion of a shut-off unit 112 into an opening 110.

As shown in FIG. 1*a*, a drive device 114 can be coupled to a drive agency 116 and coupled to a power supply 118. In some embodiments, a power supply 118 can be a battery, but in other embodiments can be a solar cell or any other known and/or convenient device. In some embodiments, a drive device 114 can be a motor, but in other embodiments can be any other known and/or convenient mechanism. In the embodiment shown in FIG. 1*a*, a drive agency 116 can be at least one wheel, but in other embodiments can be a caster, bearing, or any other known and/or convenient device.

In alternate embodiments, a drive device 114 can further comprise a pump and/or turbine system. In such embodiments, a drive agency 116 can be a nozzle, propeller, or any other known and/or convenient device to produce thrust. In such embodiments, moving agencies 106 can be fins or any other known and/or convenient device.

Figure 2:
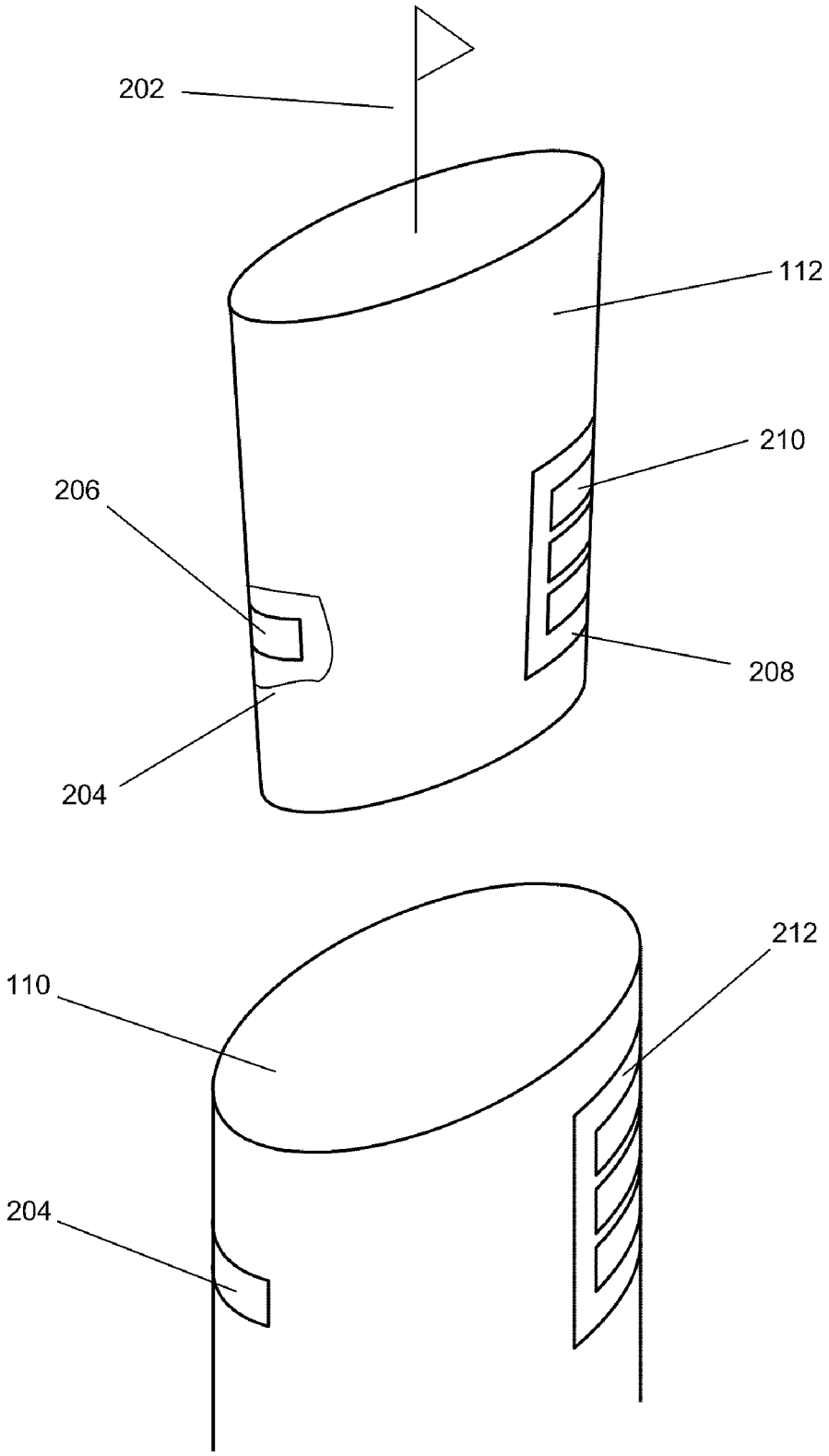
FIG. 2 depicts a detail perspective view of an embodiment of a shut-off device in the present device.

FIG. 2 depicts a detail view of one embodiment of a shut-off device 112. As shown in FIG. 2, a shut-off device 112 can further comprise a visual enhancement device 202 that can be a flag, two-dimensional or three-dimensional graphic, or any other known and/or convenient device. A shut-off unit 112 can further comprise a control mechanism 204 that can control stop-and-go motion of the device. In some embodiments, a control mechanism 204 can comprise an electrical coupling 206 that when disrupted causes the device to cease motion. In some embodiments, an electrical coupling 206 can further comprise magnetic components. However, in other embodiments, any other known and/or convenient control mechanism can be used.

In some embodiments, as shown in FIG. 2, a shut-off unit 112 can further comprise a motion-control device 208, which can further comprise at least one magnet 210. In some embodiments, a motion-control device 208 can be a magnetostatic device with said at least one magnet 210 capable of producing an electrical current that can be used to create a seed value for input into a random-pattern generator. A reader 212 can be located in an opening 110 such that a pattern and/or random sequence can be defined by a magnetic configuration of at least one magnet 210 on a shut-off unit 112 and/or the speed of insertion of a shut-off unit into an opening 110.

Figure 3:
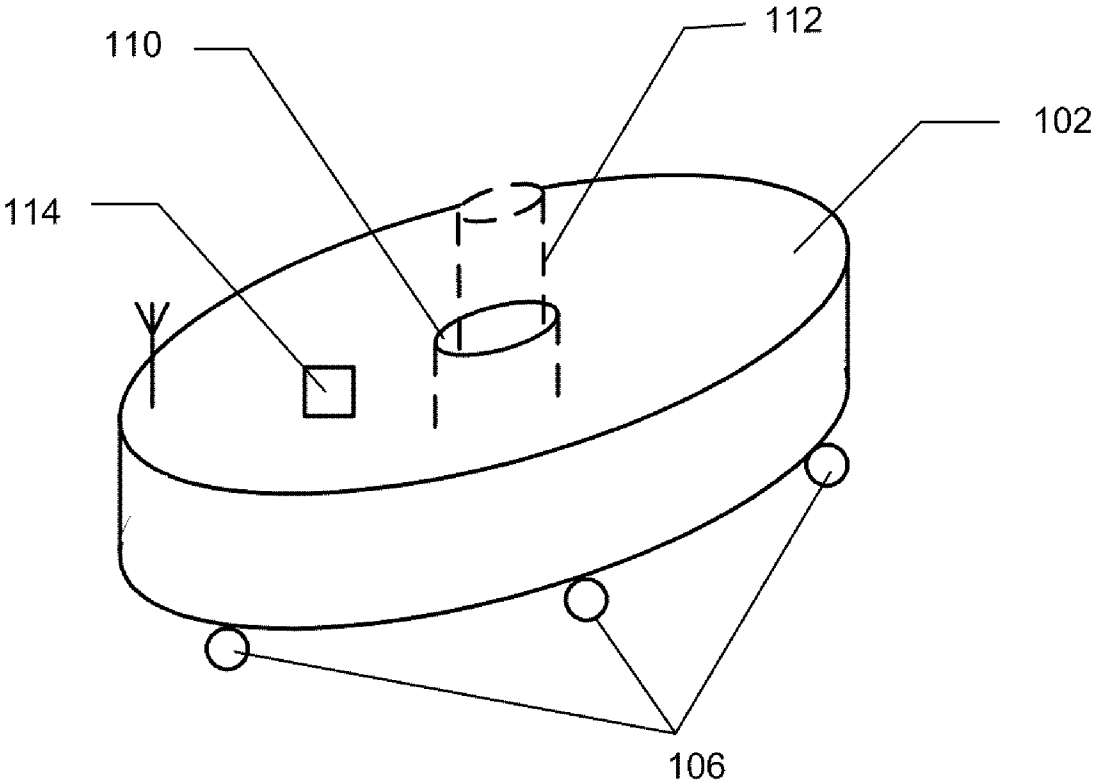
FIG. 3 depicts another embodiment of the present device further comprising a remote-control unit.
Figure 3:
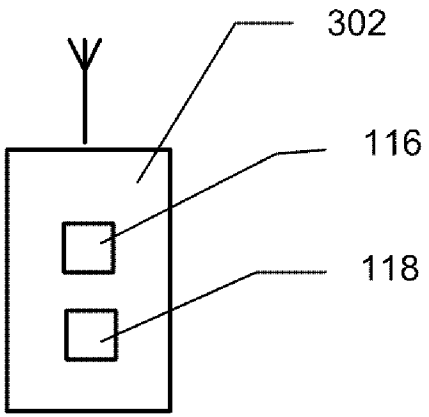

FIG. 3 depicts another embodiment of the present device, further comprising a remote-control unit 302. A remote-control unit 302 can operate via a wireless connection or any other known and/or convenient mechanism.

Figure 4:
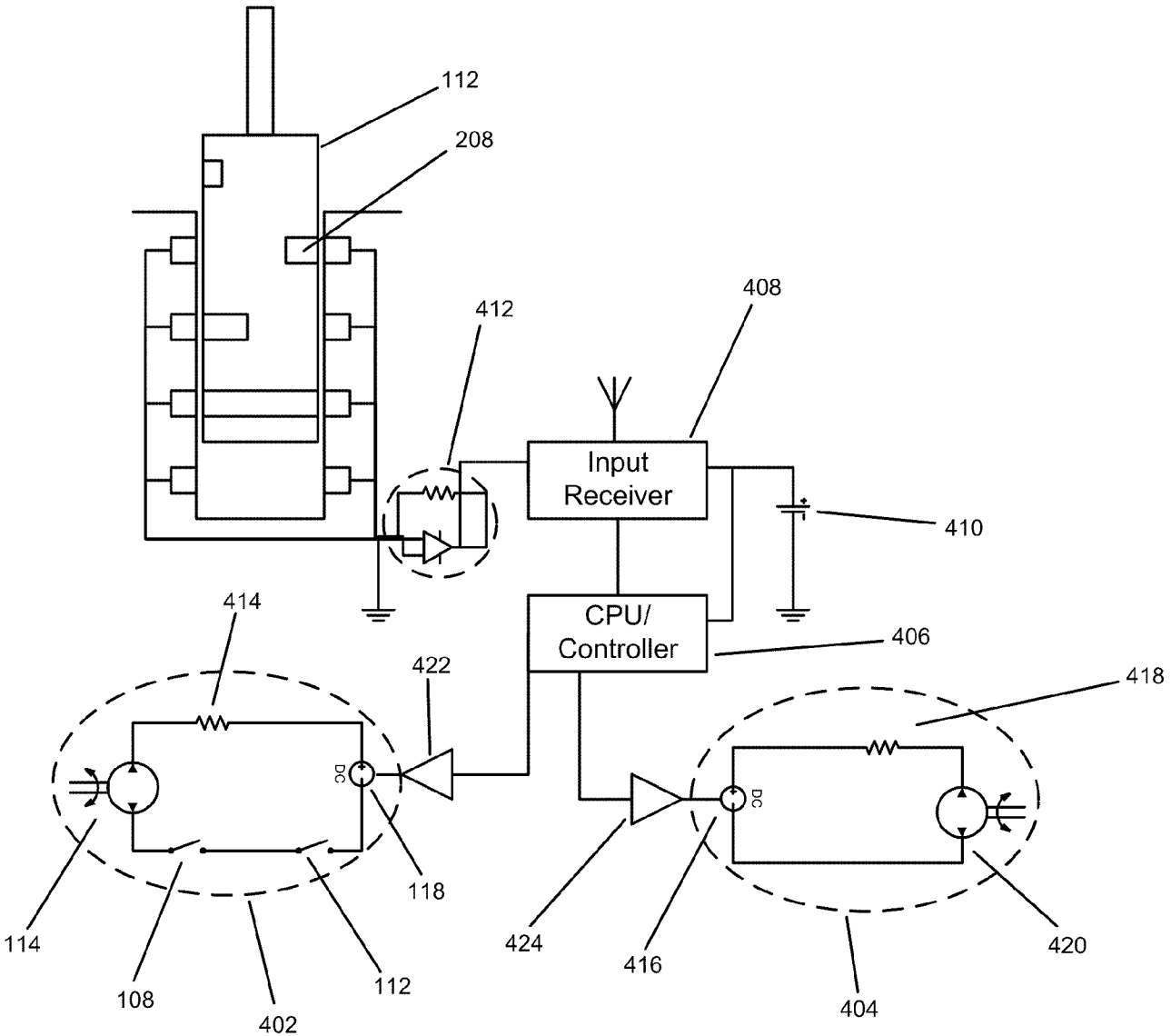
FIG. 4 depicts a schematic diagram of one embodiment of the present device.

FIG. 4 depicts an electro-mechanical schematic of one embodiment of the present device. A drive-control circuit 402 and a directional-control circuit 404 can both be connected to a central processing unit (CPU) 406. A CPU 406 can be connected to an input device/receiver 408, which can be connected to a power supply 410. A motion-control device 208 can be connected to an input device/receiver 408 via an op-amp circuit 412. A remote-control 302 can also provide input to an input device/receiver 408 via a wireless connection or any other known and/or convenient method. In some embodiments, a CPU 406 can also be capable of collecting motion information from the device and connecting to an external personal computer to download such information. Further, in some alternate embodiments, a device can include a timing mechanism 120 (as shown in FIG. 1) to record and optionally display chronological information regarding motion of the device.

In a drive-control circuit 402, a power supply 118 can be connected to a shut-off device 112, an on-off switch 108, a drive device 114, and a resistor 414, In some embodiments, a drive device 114 can be a motor, but in other embodiments can be any other known and/or convenient device. As shown in FIG. 2, a power supply 118 can be a variable power supply, or in other embodiments can be any other known and/or convenient device.

In a directional-control circuit 404, a power supply 416 can be connected to a resistor 418 and a drive device 420. In some embodiments, a drive device 420 can be a motor, but in other embodiments can be any other known and/or convenient device.

A CPU 406 can be connected to a power supply 118 for a drive circuit 402 via an amplifier 422, and also to a power supply 416 for a directional-control circuit 404 via and amplifier 242. In such embodiments, a CPU can, therefore, provide input to control a drive circuit 402 and a directional-control circuit 404.

A remote-control unit 302 can provide input concerning direction, speed, on/off status, or any other known and/or desired parameters to an input device/receiver 408.

As shown in FIG. 4, a motion-control device 208 can, in some embodiments, be incorporated into a shut-off device 112. A magnet 210 on a shut-off device 112 can, when in motion, produce a current that can be read by a reader 212. An induced current can vary depending upon the orientation of magnets 210 in relation to readers 212 and the speed of magnets 210 in moving past readers 212. In embodiments having multiple magnets 210 and readers 212, as shown in FIG. 4, the electrical signals resulting from an induced current can be summed in an op-amp circuit 412 and sent to a CPU 406 via an input device/receiver 408. A CPU 406 can process these electrical signals to provide control information to a drive-control circuit 402 and a directional-control circuit 404 by using electrical signals to establish a seed value for a random-number generator in a CPU 406. In some embodiments, a random number generator can translate an electrical signal into numerical values. In such embodiments, a numerical value can be parsed into separate values, each of which can be used to control speed and direction. For example, in some embodiments, a numerical value can have a plurality of digits. One or more digits can correspond to a seed value for speed control, one or more other digits can correspond to a seed value for the control time period, and at least one remaining digit can correspond to a seed value for directional control.

Figure 5:
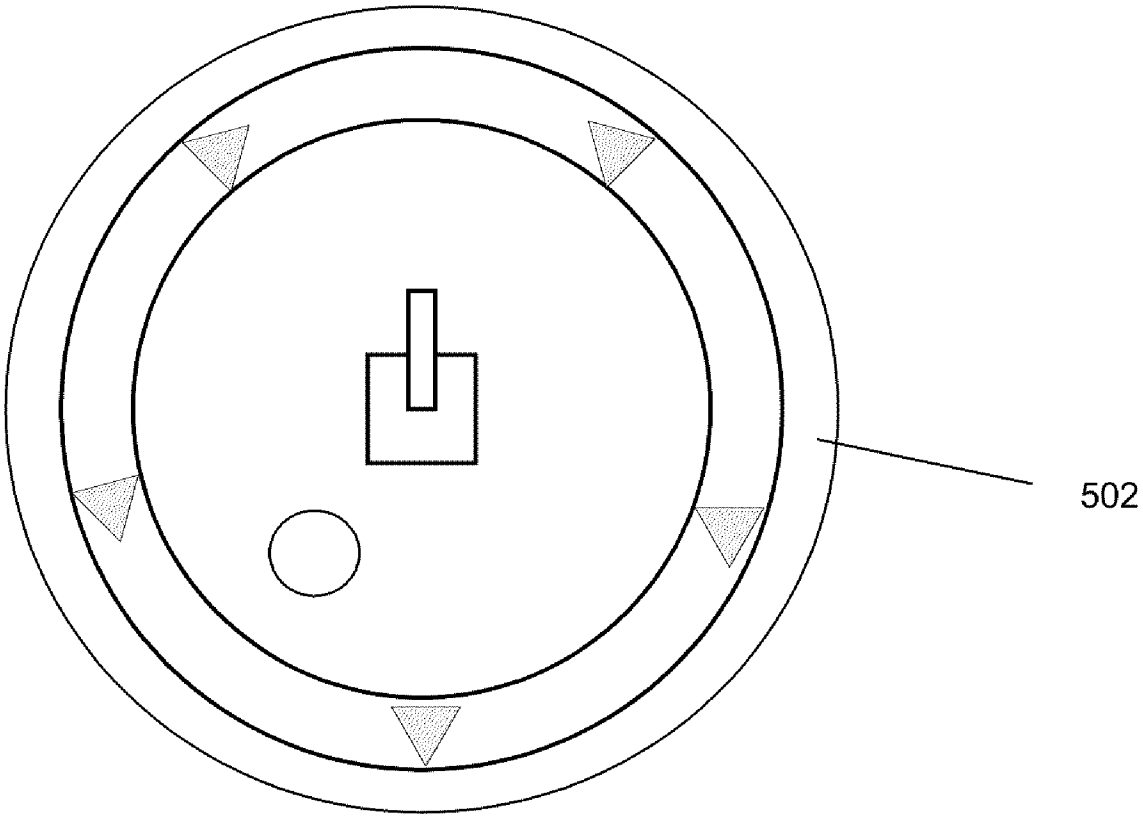
FIG. 5 depicts a bottom view of another embodiment of the present device that can operate in an aquatic environment.

FIG. 5 depicts another embodiment of the present device that can operate in an aquatic environment. Such embodiments can further comprise a flotation device 502, which can be located circumferentially around a housing 102, or in any other known and/or convenient position. In some embodiments, a housing 102 can be comprised of a buoyant material.

Figure 6:
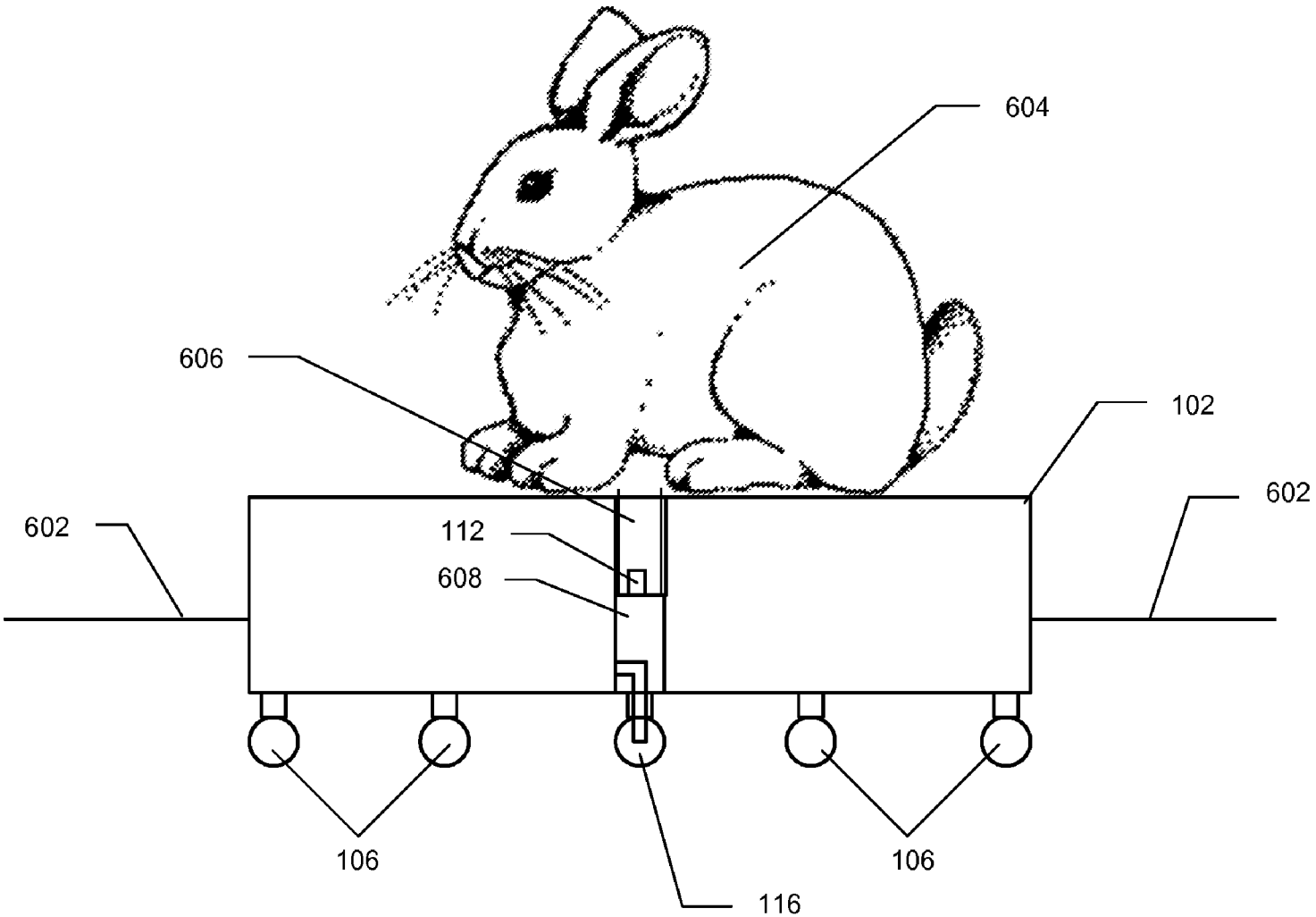
FIG. 6 depicts a side view of an alternative embodiment of the present device.

FIG. 6 depicts a side view of another embodiment of the present device. In some embodiments, a housing 102 can include extension arms 602 adapted to reduce the likelihood of overturning the device. Moreover, in some embodiments the shut-off unit 112 can be coupled with an object 604. In some embodiments, an object 604 can have the shape of a rabbit and/or any desired shape. In some embodiments, a shut-off unit 112 can include a depression 216 that can mate with a protrusion at the base of the opening 110. In some embodiments, the protrusion can be coupled with a rotational motor 608 such that as the motor rotates, both the drive agency 116 and the object 604 can rotate in unison. In alternate embodiments, the object 604 and drive agency 116 can move and/or rotate independently.

In use, a user can turn a switch 108 to the "on" position and insert a shut-off unit 112 into an opening 110. The present device can then begin to move about and be chased by a person, who could have the goal of overtaking the device and removing the shut-off unit 112, which would cause the device to stop moving. A person can also chase the device without the goal of removing a shut-off unit 112, but rather to follow a prescribed pattern. In some embodiments, motion of the device can be determined by a magnetostatic device that produces a random movement pattern. In other embodiments, motion can be controlled by a remote user via a remote-control unit 302. Either way, the erratic movement of the present device can require the person chasing the device to change motion quickly, and, therefore, develop speed and agility.

Although the method has been described in conjunction with specific embodiments thereof, it is evident that many alternatives, modifications and variations will be apparent to those skilled in the art. Accordingly, the method as described and hereinafter claimed is intended to embrace all such alternatives, modifications and variations that fall within the spirit and broad scope of the appended claims.

What is claimed is:

1. An athletic training device, comprising:

a housing having at least one section;

a plurality of moving agencies coupled with said housing;

an opening in the outer surface of said housing;

a shut-off unit selectively mated with said opening and having an electrical coupling capable of shutting off the device when said coupling is interrupted;

a motion-control device and a remote-control device connected to an input device via an op-amp circuit, said input device further comprising a power supply;

a central processing unit connected to said input device;

a drive mechanism further connected to said central processing unit, further comprising a drive-control circuit and a directional-control circuit, said drive-control circuit and said directional-control circuit being connected to said central processing unit via an amplifier, wherein said drive-control circuit is connected to said electrical coupling on the shut-off device and a power supply.

2. The device of claim 1, wherein said drive-control circuit comprises a drive device, an on/off switch, said electrical coupling on said shut-off device, a resistor and a power supply; and wherein said directional-control circuit comprises a second drive device, a resistor, and a second power supply.

3. The device of claim 2, wherein said first drive device and said second drive device are motors.

4. The device of claim 2, wherein said first power supply and said second power supply are variable.

5. The device of claim 1, wherein motion-control device is integrated with said shut-off unit.

6. The device of claim 5, wherein said motion control device further comprises a magnetostatic device that produces an electrical field that calculates an initial seed value by which said central processing unit generates a pattern of random motion to control said drive-control circuit and said directional-control circuit.

7. The device of claim 1, wherein said device further comprises a visual enhancement extension.

8. The device of claim 1, further comprising a remote-control unit.

9. The device of claim 1, further comprising a timing mechanism and display.

10. The device of claim 1, wherein said central processing unit further is capable of recording chronological information and downloading said chronological information to an external device.

11. The device of claim 10 wherein said central processing unit is capable of recording and spatial information and downloading said spatial information to an external device.

12. The device of claim 1, further comprising a flotation device.

13. The device of claim 10, wherein said moving agencies are fins, said drive agency further comprises at least one nozzle and said drive device further comprises a pump system.

* * * * *